United States Patent [19]

Morrow

[11] 4,054,095

[45] Oct. 18, 1977

[54] PROCESS FOR ELECTROLESS METAL COATING OF NITROCELLULOSE BASE PROPELLANTS, AND ARTICLE

[75] Inventor: Scott I. Morrow, Denville, N.J.

[73] Assignee: The United States of America as represented by the Secretary of the Army, Washington, D.C.

[21] Appl. No.: 689,289

[22] Filed: May 24, 1976

[51] Int. Cl.[2] ..... C23C 3/02

[52] U.S. Cl. ..... 102/39; 102/DIG. 1; 427/304; 427/306; 428/462; 428/464

[58] Field of Search ..... 149/79, 98; 427/304, 427/305, 306, 170; 102/39, 28 R, DIG.1, 103; 106/166; 428/462, 464

[56] References Cited

U.S. PATENT DOCUMENTS

| | | | |
|---|---|---|---|
| 3,299,812 | 1/1967 | Suh et al. | 102/39 |
| 3,669,714 | 6/1972 | Wiley | 427/306 X |

*Primary Examiner*—Ralph S. Kendall

*Attorney, Agent, or Firm*—Nathan Edelberg; A. Victor Erkkila; Harold H. Card, Jr.

[57] ABSTRACT

Electroless metal coatings of increased adhesion are obtained on nitrocellulose base propellant films, grains, etc., by incorporating an acrylonitrile-butadiene copolymer in the nitrocellulose propellant substrate to be electrolessly coated with the metal.

12 Claims, No Drawings

PROCESS FOR ELECTROLESS METAL COATING OF NITROCELLULOSE BASE PROPELLANTS, AND ARTICLE

GOVERNMENTAL INTEREST

The invention described herein may be manufactured, used, and licensed by or for the Government for Governmental purposes without the payment to me of any royalties thereon.

BACKGROUND OF THE INVENTION

U.S. Pat. No. 3,299,812, relates to ammunition for stud drivers, rifles and the like, which includes an electric ignition cartridge comprising a pellet of a deflagrating explosive, e.g., double base smokeless powder grains containing nitrocellulose and nitroglycerin, plated with a thin metal coating, which is heated by the passage of an electric current to a temperature sufficient to ingnite the adjacent surface portion of the explosive.

A principle problem in the production of a resistance electrical ignition system (REIS) of the aforesaid type utilizing a metal plated film or grain of a nitrocellulose base deflagrating explosive, hereinafter referred to as propellant, is that the nitrocellulose because of its smooth surface does not plate well with conventional commercial electroless plating reagents. For this reason, it is difficult to obtain a metal coating, which possesses good adhesion to the nitrocellulose substrate and resistance to electrical breakdown, a common troublesome factor in attempts to ignite the nitrocellulose propellant by means of an electrical current. This tendency to electrical breakdown is a major obstacle in developing REIS igniters, which ignite with sufficient speed by application of an electric current so as to be suitable for use in fast acting propellant devices such as cannon, rockets, pyrotechnic devices, etc. Speed of ignition is related among other things to voltage of the DC power supply used to ignite the REIS device. However, as the DC voltage is increased to reduce the ignition delay with electrolessly deposited copper or other metal films on nitrocellulose propellant substrates, there is a tendency for the metal film to rupture, which results in loss of its ability to further carry any current.

One method or providing a fairly satisfactory surface for plating is to roughen the nitrocellulose propellant surface mechanically with fine emery cloth, ground glass, grinding powder, etc. It is thought that the roughened surface enables the pallidium or other catalyst conventionally employed to be deposited more effectively, thereby promoting adherence of the electrolessly plated metal coating. However, from the standpoint of mass production of such metal plated nitrocellulose base REIS igniters, surface conditioning by mechanical pretreatment is objectionable, since it requires special equipment, extended process time or at least considerable hand labor and hence involves expensive operations.

SUMMARY AND DETAILED DESCRIPTION OF THE INVENTION

An object of the present invention is to provide a method for producing electrolessly deposited metal coatings on nitrocellulose base propellants, which possess improved adhesion, without the need for costly, time-consuming roughening of the nitrocellulose propellant substrate prior to plating with the metal.

Another object is to provide a nitrocellulose propellant having an improved surface for electroless deposition of metals thereon.

A further object is to provide a method adapted for mass production of metal coated nitrocellulose base REIS igniters, which can be readily ignited by the application of low voltage DC current, and can easily ignite a propellant charge and leave negligible residue in the mechanism of a gun, such as a cannon.

Other objects will become apparent as the invention is further described.

It has now been unexpectedly found that the foregoing objects can be achieved by incorporating a copolymer of acrylonitrile and butadiene in the nitrocellulose propellant substrate and coating the thus conditioned substrate with an electrically conductive metal, such as copper, by electroless plating methods.

The acrylonitrile-butadiene copolymer can be incorporated in the nitrocellulose propellant substrate in any suitable manner. One method comprises dissolving the copolymer and the nitrocellulose propellant in a mutual solvent, e.g., acetone, and removing the solvent by evaporation, whereby the copolymer is precipitated and uniformly distributed in finely divided form throughout the nitrocellulose. A preferred method comprises preparing a solution of the copolymer and the nitrocellulose in a suitable solvent (which term includes a single or a mixture of solvents), then partially removing the solvent by vaporization until a doughy mass is produced, and finally processing the mass in a heated mixer or on heated steel rolls to evaporate the solvent and consolidate the mixture into a uniform composition in the form of grains, sheets, etc., containing a uniform dispersion of the copolymer in the nitrocellulose propellant, which can be extruded or pressed into suitable shaped, if desired.

The nitrocellulose propellant substrates which can be conditioned with a copolymer of acrylonitrile and butadiene according to the present invention include single and double base propellants, which contain from 50% to 100% by weight of nitrocellulose having a nitrogen content between 12 and 14.14%. Such propellants can also contain other ingredients, e.g. 0 to 5% by weight of nitrocellulose stabilizers, e.g. diphenylamine, 2-nitrodiphenylamine, and sym-diethyldiphenylurea; 0 to 50% by weight of plasticizers including nitrate type plasticizers, e.g. nitroglycerin, diethyleneglycol dinitrate, triethyleneglycol dinitrate, metriol trinitrate and 1,2,3- and 1,2,4 -butanetriol trinitrates, and/or fuel type plasticizers, e.g. triacetin and the dimethyl, diethyl, dibutyl, and di(2-ethylhexyl) esters of o-phthalic, adipic and sebacic acids; and 0–10% by weight of crystalline nitramine explosives, e.g., cyclotrimethylenetrinitramine and cyclotetramethylenetetranitramine.

Suitable acrylonitrile-butadiene copolymers for use in the process of the present invention can vary widely as to acrylonitrile content, which can range about from 10 to 90% of the copolymer. Particularly desirable copolymers possess an acrylonitrile content ranging about from 25% to 45% and a Mooney viscosity, ML-4 at 212° F. ranging about from 20 to 110.

The acrylonitrile-butadiene copolymer is incorporated in the nitrocellulose propellant substrate in an amount effective to increase the adhesion to the substrate of the metal coating produced. The amount of copolymer thus incorporated is preferably at least 1%, and especially between about 5% and 25%, by weight based on the nitrocellulose content of the propellant substrate. Amounts of copolymer substantially greater than 50% by weight, while effective, are generally less desirable since they tend to retard the ignition of the nitrocellulose propellant.

The present invention can be employed with electrolessly platable metals other than copper, such as for example, nickel, silver, tin, gold, cobalt, and palladium, to increase the adhesion of the metal film produced on nitrocellulose substrates, e.g., film and grains. Various electroless methods for plating metals are known in the art and can be utilized, as appropriate.

The following examples provide further specific illustration of the method of carrying out the process of the present invention.

EXAMPLE 1

0.283 gram of acrylonitrile-butadiene copolymer was dissolved in a solution of 1.814 grams of nitrocellulose (12.6%N) in the 160cc of acetone, producing a composition consisting of 13.3% copolymer and 86.7% by weight nitrocellulose, solids basis (The acrylonitrile-butadiene copolymer employed is marketed by the Firestone Co. under the tradename FR-N® 607 Polymer and has an acrylonitrile content of 32% and a Mooney viscosity ML-4 at 212° F. of 50–60.). The solution thus obtained was poured into a 10.4 by 12.5 cm rectangular polyethylene tray, and the acetone was removed by evaporation with a stream of dry nitrogen. The dry nitrocellulose film thus obtained was peeled from the tray and cut into several pieces which were then allowed to age for several days prior to plating operations.

One piece was then plated without any abrading pretreatment with electroless copper plating reagents at room temperature by immersing the film successively in the following baths sold by the Shipley Company, Newton, Massachusetts:

1. Cuposit® Conditioner 1160, 1 minute
2. Cuposit® Catalyst 9F, 3 minutes
3. Cuposit® Accelerator 19, 3 minutes
4. Cuposit® PM-990 Electroless Copper, 6 minutes (Baths 2 and 3 are disclosed in U.S. Pat. No. 3,011,920; bath 4 is disclosed in U.S. Pat. No. 3,846,138.) The film was thoroughly rinsed with distilled water after each bath. The copper plated film thus obtained was air dried and a strip 0.5 by 4.85 cm was cut therefrom. The side of the film strip cast in contact with the polyethylene tray was smooth and had a resistance of 3.0 ohms, measured end-to-end of the strip; while the opposite side of the film strip was relatively rough and wavy and had a resistance of 3.8 ohms measured similarly. Contacts of copper foil were clamped to each end of the strip with alligator clips connected to the electrical leads from a DC power source, which had a variable voltage control. The distance between the foil contacts was 4 cm. The voltage was increased from 0 to 25 volts within a few seconds. The film ignited immediately with copious flaming, leaving negligible residue.

Another piece of the film obtained above was thoroughly abraded on both sides by hand with wet ground glass and electrolessly copper plated in the same manner as described above. A strip 0.5 by 4.85 cm was cut from the copper plated film and connected to a DC power source in the aforesaid manner. The distance between the copper lead contacts was 3.5 cm. The strip ignited within 1–2 seconds when the current was turned on at a 25-volt setting.

A control film of nitrocellulose was prepared and copper plated in the same manner as described above except that the acrylonitrile-butadiene copolymer was omitted. An unsatisfactory copper plate was thereby obtained on both sides of the nitrocellulose film, i.e., the copper adhered poorly and showed poor resistance to electrical breakdown.

EXAMPLE 2

0.708 gram of acrylonitrile-butadiene copolymer of the type described in Example 1 was dissolved in a solution of 4.536 grams of nitrocellulose of 12.6% nitrogen content and 0.0855 gram of diphenylamine stabilizer in 400 cc of acetone, thereby producing a composition containing 1.6% diphenylamine, 13.3% of the copolymer and 85.1% by weight of the nitrocellulose solids basis. The resulting solution was poured into a 20.3 by 17.8 cm rectangular polyethylene tray and the solvent was removed by evaporation with a stream of nitrogen. The film was peeled from the tray and allowed to age for several days before being subjected to plating operations.

One piece of the film, without any abrading pretreatment, was electrolessly plated with copper in the manner described in Example 1.

Another piece of the film was thoroughly abraded on both sides by hand with fine wet ground glass prior to plating with copper in the aforementioned manner.

A control film of diphenylamine stabilized nitrocellulose was prepared and copper plated without any abrading pretreatment in the manner described above except that the acrylonitrile-butadiene copolymer was omitted.

Another piece of the control film was thoroughly abraded on both sides by hand with fine wet ground glass prior to plating with copper in the manner described above.

Microscopic examination of the plated films thus obtained revealed the following results:

The control film plated without any abrading pretreatment, showed gaps and poor adhesion of the copper plate to the nitrocellulose substrate, indicating unsatisfactory resistance to electrical breakdown. By contrast, the copper plate, obtained on the copolymer conditioned film without any abrading pretreatment, possessed much better uniformity and adhesion to the substrate than the copper plated obtained on the control films obtained without any abrading pretreatment.

The control film, plated with abrading pretreatment, possessed better adhesion of the copper coat to the nitrocellulose substrate than the control film plated without any abrading pretreatment, but a microscopic examination showed many raised metal blobs and outlines of abrasion scratches, indicating nonuniformity of the metal coating. By comparsion, the copper plate obtained on the copolymer conditioned substrate with similar abrading pretreatment, showed fewer raised metal blobs and a less imperfect metal coating surface than that of the control film similarly plated with abrading pretreatment.

The foregoing disclosure is merely illustrative of the principles of this invention and are not to be interpreted in a limiting sense. I wish it to be understood that I do not desire to be limited to the exact details of construction shown and described, because obvious modifications will occur to a person skilled in the art.

What is claimed is:

1. In a method for producing a metal coating on a nitrocellulose base propellant substrate, wherein the metal is deposited on the nitrocellulose substrate from an electroless metal plating bath, the improvement which comprises incorporating in the nitrocellulose substrate to be coated an effective amount of an acrylonitrile-butadiene copolymer to increase the adhesion of the metal coating produced.

2. The method of claim 1, wherein the amount of the acrylonitrile-butadiene copolymer is between 1% and 50% by weight of the nitrocellulose content of the propellant substrate.

3. The method of claim 1, wherein the nitrocellulose contains between about 12% and 14.14% nitrogen.

4. The method of claim 1, wherein the amount of the acrylonitrile-butadiene copolymer is between about 5% and 25% by weight of the nitrocellulose content of the propellant substrate.

5. The method of claim 1, wherein the metal is copper.

6. The method of claim 1, wherein the nitrocellulose substrate is in film or sheet form.

7. The method of claim 1, wherein the copolymer possesses an acrylonitrile content ranging about from 10% to 90% by weight.

8. The method of claim 1, wherein the copolymer possesses an acrylonitrile content ranging about from 25% to 45% by weight and a Mooney viscosity at 212° F ranging about from 20 to 110.

9. An electroless metal plated nitrocellulose base propellant substrate, said substrate comprising an effective amount of an acrylonitrile-butadiene copolymer to increase the adhesion of the metal plating to said substrate.

10. The substrate of claim 9, wherein the amount of the copolymer is between 1% and 50% by weight of the nitrocellulose content of the substrate.

11. The substrate of claim 9, wherein the copolymer possesses an acrylonitrile content ranging about from 10% to 90% by weight.

12. The substrate of claim 9, wherein the copolymer possesses an acrylonitrile content ranging about from 25% to 45% by weight and a Mooney viscosity at 212° F ranging about from 20 to 110.

* * * * *